US006460903B1

(12) United States Patent
Ming-Chih

(10) Patent No.: US 6,460,903 B1
(45) Date of Patent: Oct. 8, 2002

(54) LOCKING MECHANISM OF ELECTRONIC LOCK

(75) Inventor: Chen Ming-Chih, Taichung (TW)

(73) Assignee: Summit Automation Co., LTD, Taichung (TW)

( * ) Notice: Subject to any disclaimer, the term of this patent is extended or adjusted under 35 U.S.C. 154(b) by 175 days.

(21) Appl. No.: 09/704,403

(22) Filed: Oct. 31, 2000

(51) Int. Cl.[7] ..... F05C 1/12
(52) U.S. Cl. ..... 292/172; 70/280; 70/278.1
(58) Field of Search ..... 70/275, 277, 278.1, 70/280, 281, 282; 292/144, 172, 142

(56) References Cited

U.S. PATENT DOCUMENTS 4,967,305 A * 10/1990 Murrer et al.
5,473,922 A * 12/1995 Bair et al. ..... 70/416
5,694,798 A * 12/1997 Nunez et al. ..... 70/283
5,956,998 A * 9/1999 Fenelon ..... 74/89.17
6,032,991 A * 3/2000 Yeh ..... 292/336.3
6,334,348 B1 * 1/2002 Ming-Chih ..... 70/472
6,360,573 B1 * 3/2002 Ming-Chih ..... 70/277

* cited by examiner

*Primary Examiner*—Anthony Knight
*Assistant Examiner*—John B. Walsh
(74) *Attorney, Agent, or Firm*—W. Wayne Liauh

(57) ABSTRACT

An electronic lock comprises a control structure having a threaded sleeve which is fitted into an actuating ring and an insertion seat. The actuating ring is provided with an outer projection having a retaining slot. The outer projection is received in the insertion slide slot of the insertion seat. The threaded sleeve is fastened with an inner sleeve seat in which a motor is mounted. The motor has a threaded shaft which is engaged with the threaded sleeve. The inner sleeve seat is fastened with the external side of a door such that the insertion slot of the insertion seat is fitted over the lock core. The inner sleeve seat is fitted into an outer sleeve seat having a plurality of retaining teeth. In light of control of the motor by a circuit board and the position confining of the inner sleeve seat, the retaining slot of the actuating ring is capable of engaging or disengaging the retaining teeth of the outer sleeve seat, so as to control the linking of the outer sleeve seat with the insertion seat to rotate the lock core, thereby resulting in the locking or the unlocking of the electronic lock.

8 Claims, 13 Drawing Sheets

LOCKING MECHANISM OF ELECTRONIC LOCK

FIELD OF THE INVENTION

The present invention relates generally to an electronic lock, and more particularly to a locking mechanism of the electronic lock.

BACKGROUND OF THE INVENTION

The locks are generally grouped into a mechanical lock and an electronic lock. As shown in FIGS. 1 and 2, the mechanical lock has a lock belly 1 which is disposed in the door body 2 and is provided in the interior thereof with a retaining block 4 linking a lock tongue 3. A control mechanism 5 disposed in the outside of the door body 2 is provided with a lock core 6 which is put through the retaining block 4 such that the lock core 6 is connected at other end thereof with a rotating mechanism 7 disposed in the door body 2. The key is inserted into the control mechanism 5 to turn the lock core 6, thereby causing the retaining block 4 to actuate the lock tongue 3 to extract or retract so as to lock or unlock the door body 2. The mechanical lock has to be worked on by a key, which is apt to be misplaced or lost. In addition, the mechanical lock is vulnerable to being tampered with by an unauthorized person.

The conventional electronic locks are generally provided with an electromagnetic control structure. For example, the U.S. patent Ser. No. 09/431,682 discloses by this inventor of the present invention an electronic lock comprising a housing 8 in which an electromagnetic coil seat 9 is disposed. The coil seat 9 is provided in a receiving slot 10 with a spring 11 and a protruded pillar 13 of an actuating block 12, with a stop ring 14 of the actuating block 12 being confined to one side of the spring 11. The actuating block 12 is provided at other end thereof with a fitting hole 15 for receiving a connection shaft 17 of an action piece 16 which is thus located at the outer sides of the coil seat 9 and the actuating block 12. The connection shaft 17 is provided at other end with a fixation piece which is connected with a handlebar 18. The coil seat 9 is locked at the outer side of the door body lock belly. When the coil seat 9 is connected with a power source to bring about a magnetic force, the action piece 16 is attracted inwards to push the actuating block 12 to displace inward to compress the spring 11. As a result, the protruded pillar 13 is inserted into the retaining block 19 to control the unlocking of the lock tongue. In the meantime, the fitting hole 15 of the actuating block 12 remains connected with the connection shaft 17, thereby resulting in the unlocking state to enable the door body to be opened. When the power supply to the coil seat 9 is interrupted, the actuating block 12 is forced by the spring force of the spring 11 to move back to its original position. As a result, the protruded pillar 13 moves away from the retaining block 19, without being capable of controlling the action of the lock tongue. The lock is thus in the locking state. In light of the electronic lock being controlled electromagnetically, the electronic lock remains automatically in the locking state as soon as the power source of the electronic lock is interrupted. In order to keep the electronic lock in the unlocking state to facilitate the people to go through the door, the power source of the electronic lock must be kept on to enable the door knob to be linked with the retaining block 19, thereby resulting in an excessive power consumption.

SUMMARY OF THE INVENTION

The primary objective of the present invention is to provide an electronic lock which is relatively simple in construction and is energy efficient.

In keeping with the principle of the present invention, the foregoing objective of the present invention is attained by the electronic lock comprising a rotating mechanism which is disposed in the internal side of a door body and is provided with a lock core. The lock core is linked with a retaining mechanism to control the action of the lock tongue. A locking structure is disposed in the external side of the door body such that the locking structure is connected with the lock core for controlling the action of the lock tongue. The locking structure comprised a threaded sleeve having inner threads and a lug. The threaded sleeve is fitted into an actuating ring having an outer projection which-is provided with a retaining slot. An insertion seat is fastened with the front end of the threaded sleeve such that the insertion slide slot of the insertion seat receives the outer projection of the actuating ring. An inner sleeve seat is provided with a notch which is in turn provided. with a position confining slot for retaining the lug of-the threaded sleeve. The inner sleeve seat is provided in the rear end with a motor with a threaded shaft which is engaged with the threaded sleeve. The inner sleeve seat is fixed in the external side of the door body such that the inner sleeve seat is opposite in location to the lock core, which is fitted into the insertion slot of the insertion seat. The lock core is linked with the lock tongue of the retaining mechanism. The inner sleeve seat is further provided with an outer sleeve seat having retaining teeth for meshing with the retaining slot of the actuating ring. Before the lock is unlocked, the encode-decode is entered in the external side of the door body. The encode-decode is entered by means of the keyboard, the remote controller, the sensor, etc. The motor is electronically started such that the threaded sleeve actuates the actuating ring to displace axially in the inner sleeve seat such that the retaining slot of the actuating ring is engaged with the retaining teeth of the outer sleeve seat. The outer sleeve seat is linked with the insertion seat via the actuating ring. As a result, the lock core can be turned to enable the door body to be opened. The electronic lock is locked by entering the decode. The motor is started to drive the threaded sleeve to displace in reverse, thereby causing the retaining slot of the actuating sleeve to move away from the retaining teeth of the outer sleeve seat. As a result, the outer sleeve seat is no longer able to link the insertion seat so as to rotate the lock core. The lock core can not be turned from the external side of the door body.

As soon as the motor is stopped operating, the threaded sleeve is fixed. In spite of power interruption, the outer sleeve seat is still linked with the lock core to keep the electronic lock in the unlocking state for a prolonged period of time without power consumption by the electronic lock of the present invention.

The structures and the functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
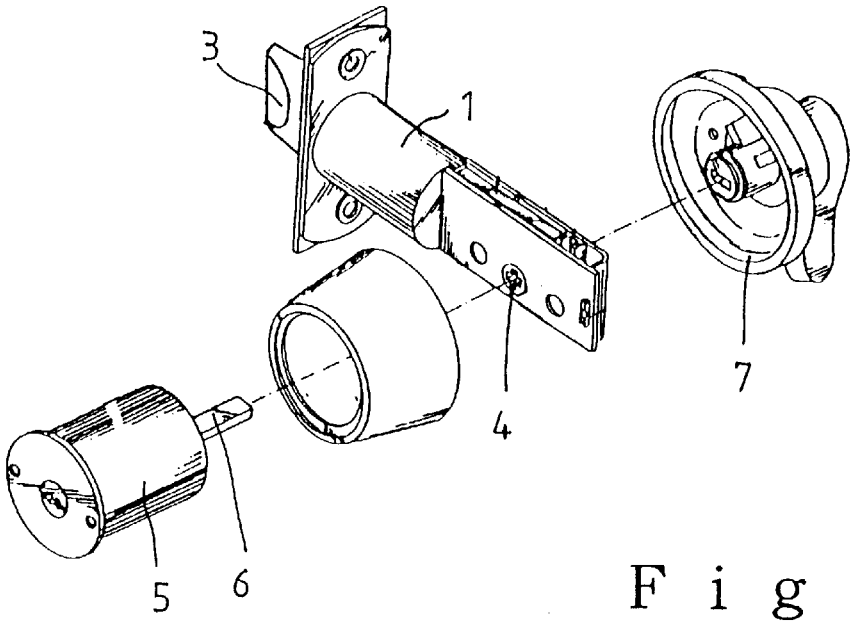
Fig. 1 PRIOR ART
FIG. 1 shows a schematic view of a mechanical lock of the prior art.
Figure 2:
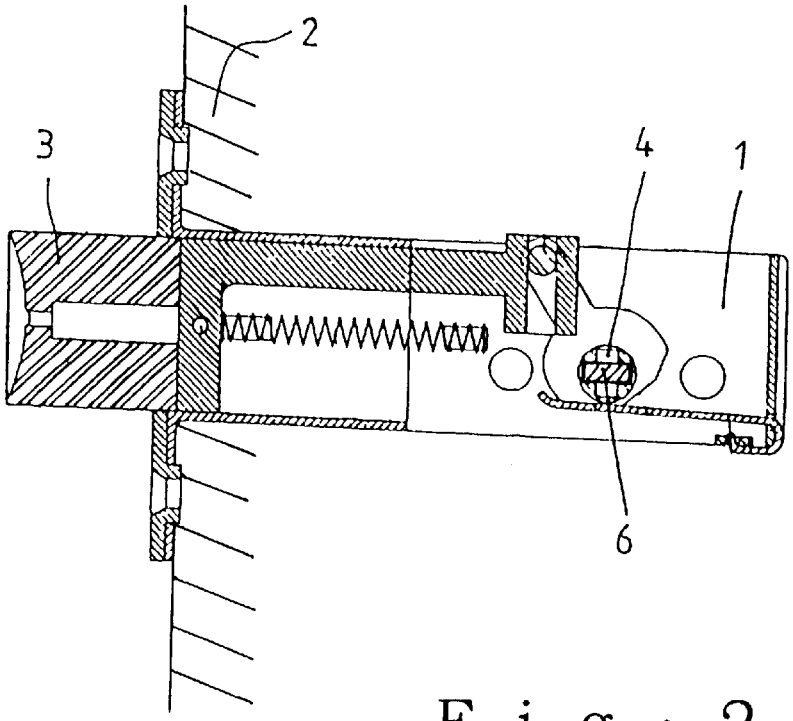
Fig. 2 PRIOR ART
FIG. 2 shows another schematic view of the prior art mechanical lock.
Figure 3:
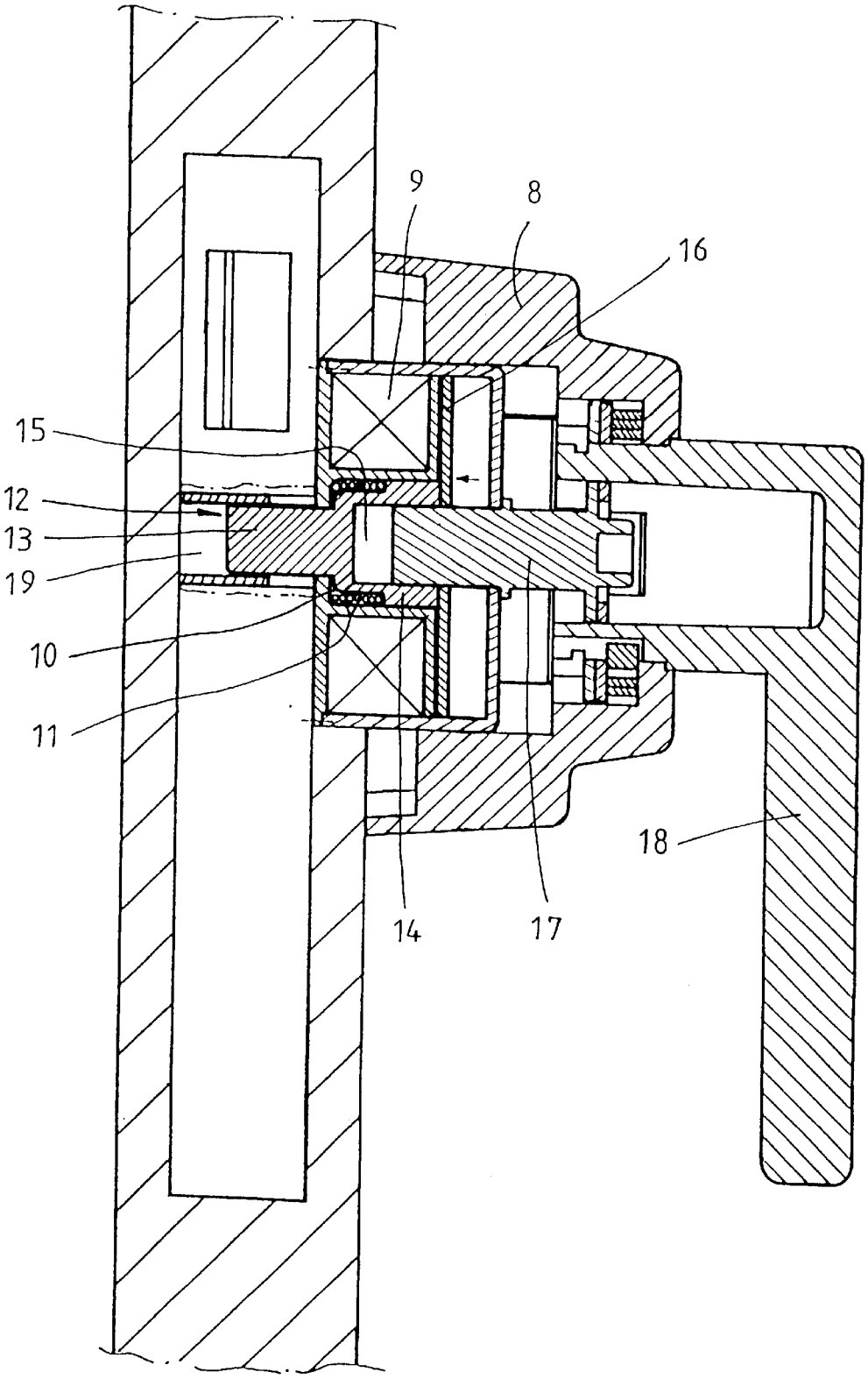
Fig. 3 PRIOR ART
FIG. 3 shows a schematic view of an electronic lock disclosed in the U.S. patent Ser. No. 09/431,682.
Figure 4:
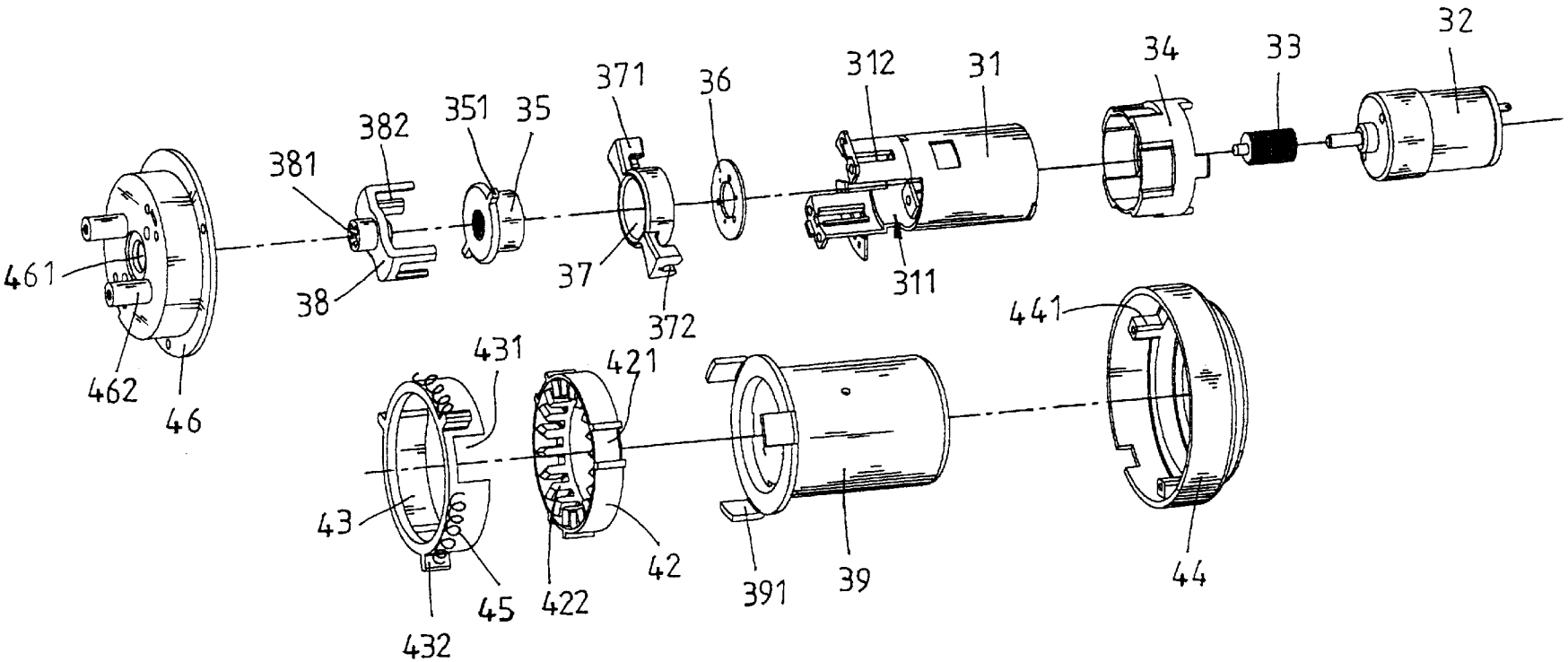
FIG. 4 shows an exploded view of the present invention.
Figure 5:
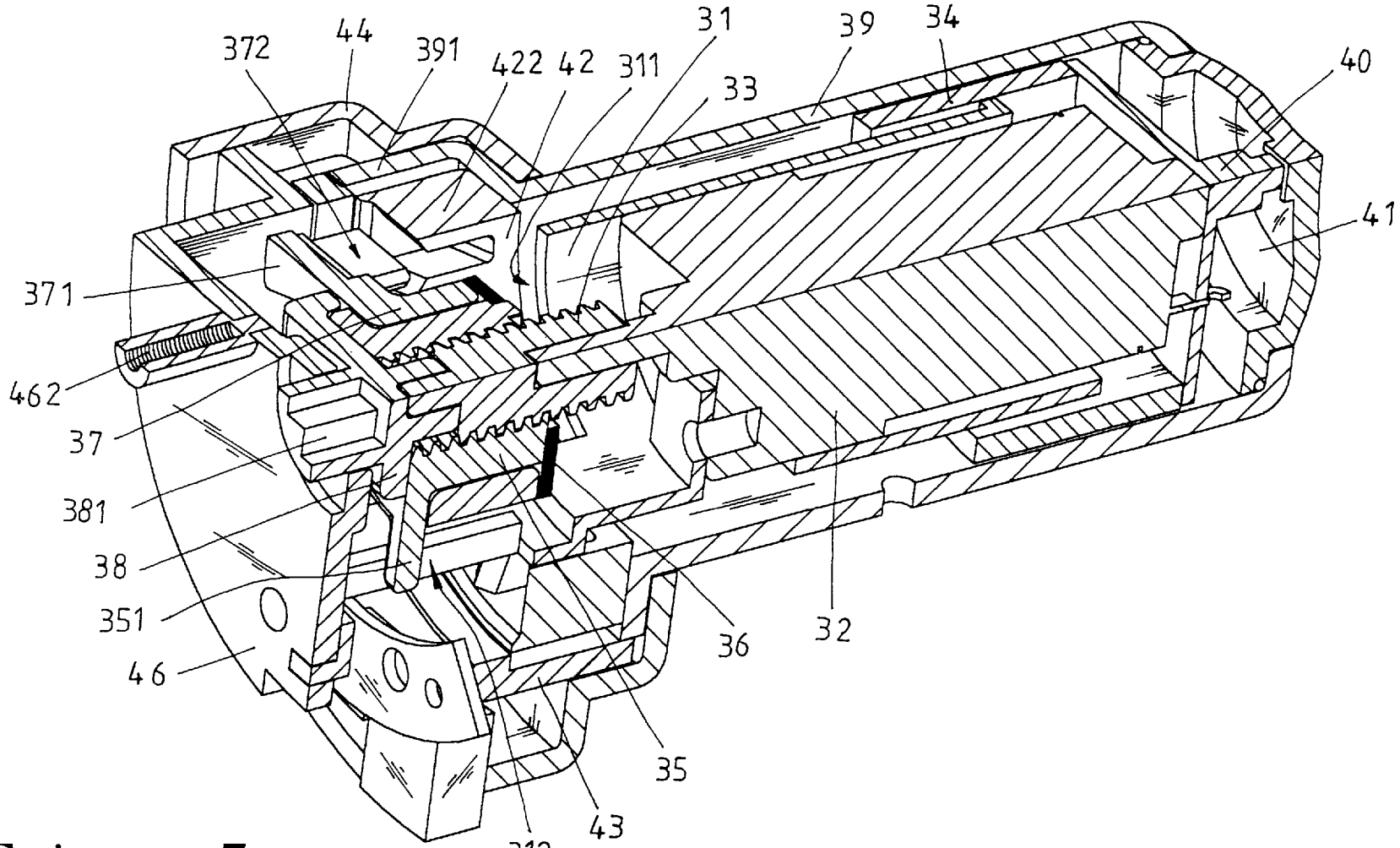
FIG. 5 shows a sectional view of the present invention in combination.
Figure 6:
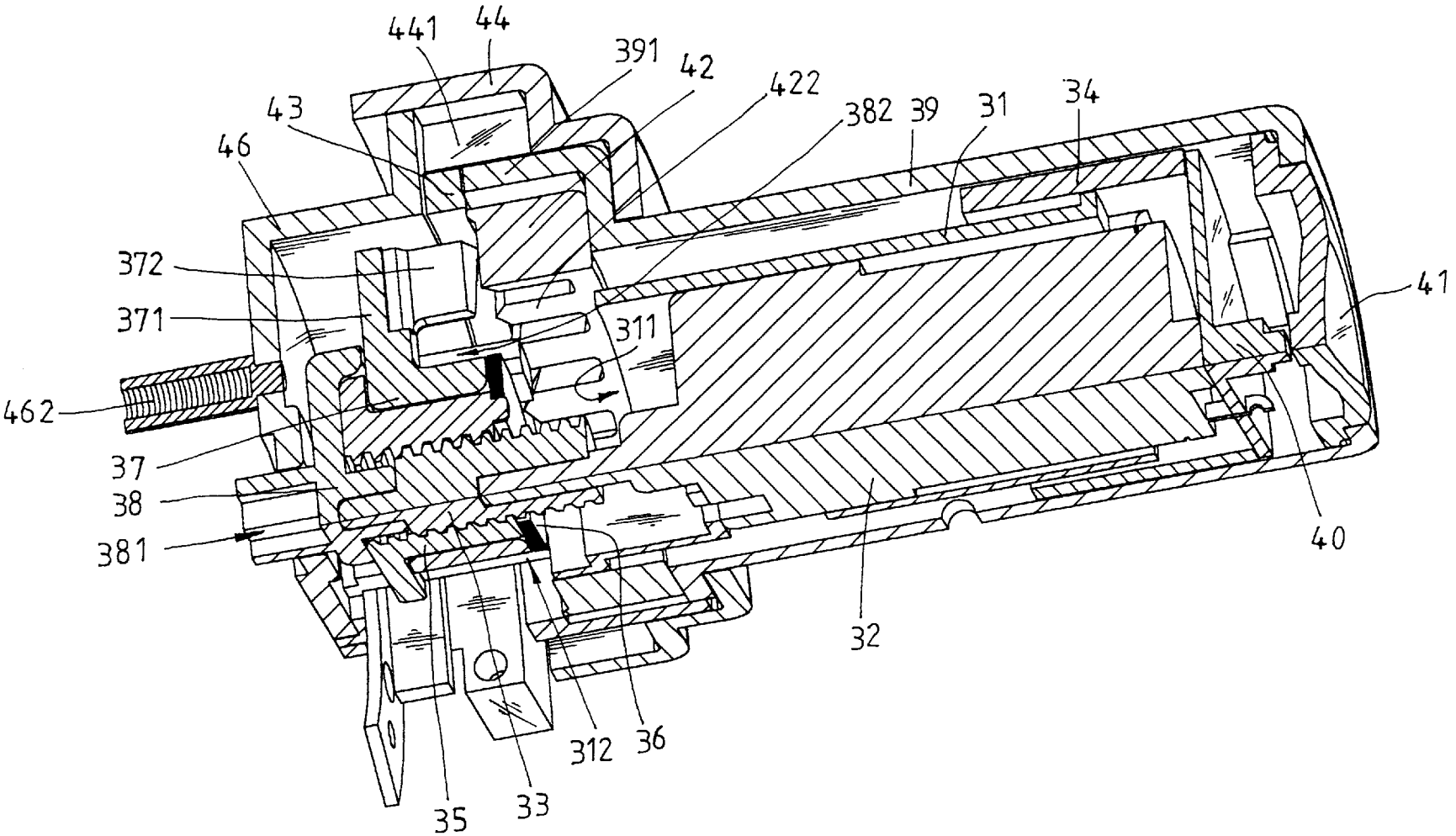
FIG. 6 shows another sectional view of the present invention in combination.

As shown in FIGS. 4–7, the control structure of the present invention comprises the component parts, which are described hereinafter.

An inner sleeve seat 31 is provided in two sides of the front end thereof with a notch 311 which is in turn provided with a position confining slot 312. The inner sleeve seat 31 is further provided in the rear end with a motor 32 fastened therewith such that the rotary shaft of the motor 32 is fastened with a threaded rod 33 and a partition ring 34.

A threaded sleeve 35 is provided at the front end with a lug 351 and an actuating ring 37 fastened with a fastening piece 36 and provided with an outer projection 371 and a retaining slot 372. The threaded sleeve 35 is disposed in the front end-of the inner sleeve seat 31 such that the lug 351 is received in the position confining slot 312, and that the outer projection 371 of the actuating ring 37 is jutted out via the notch 311. The threaded sleeve 35 has inner threads, which are engaged with the threaded rod 33 of the motor 32. When the motor 32 is in operation, the threaded rod 33 actuates the threaded sleeve 35 to turn. The threaded sleeve 35 is retained in: the position confining slot 312 of the inner sleeve seat 31 such that the threaded sleeve 35 actuates the actuating ring 37 to displace along the position confining slot 312.

An insertion seat 38 is disposed at the front end of the threaded sleeve 35 and is provided at the front end with an insertion slot 381 and an insertion slide slot 382 for receiving the outer projection 371 of the actuating ring 37.

An outer sleeve seat 39 is fitted over the inner sleeve seat 31 and is provided in the rear end with a circuit board 40 and a protective cover 41. The outer sleeve seat 39 is further provided at the front end with a plurality of insertion blocks 391.

A retaining ring 42 is provided with an insertion slot 421 corresponding in location to the insertion blocks 391 of the outer sleeve seat 39. The retaining ring 42 is further provided in the inner side with a plurality of retaining teeth 422. which are circularly arranged and are meshed with the retaining slot 372 of the actuating ring 37.

A dialing sleeve ring 43 is provided with a plurality of indentations 431 for retaining the insertion slot 421 of the retaining ring 42, and a plurality of dialing blocks 432.

A fixation sleeve ring 44 is fitted over the outer sleeve seat 39 and is provided therein with a plurality of protruded blocks 441. A spring 45 is disposed between each protruded block 441 and the dialing block 432 of the dialing sleeve ring 43.

A bottom seat 46 is provided with a through hole 461 and is further provided at the front end with a protruded bolt 462 having a threaded hole for fastening with the fixation sleeve ring 44 and the inner sleeve seat 31 such that the insertion slot 381 of the insertion seat 38 is jutted out of the through hole 461. The bottom seat 46 is fastened with the external side of a door such that the bottom seat 46 is opposite in location to the lock core, and that the insertion slot 381 of the insertion seat 38 is fitted over the lock core.

Figure 8:
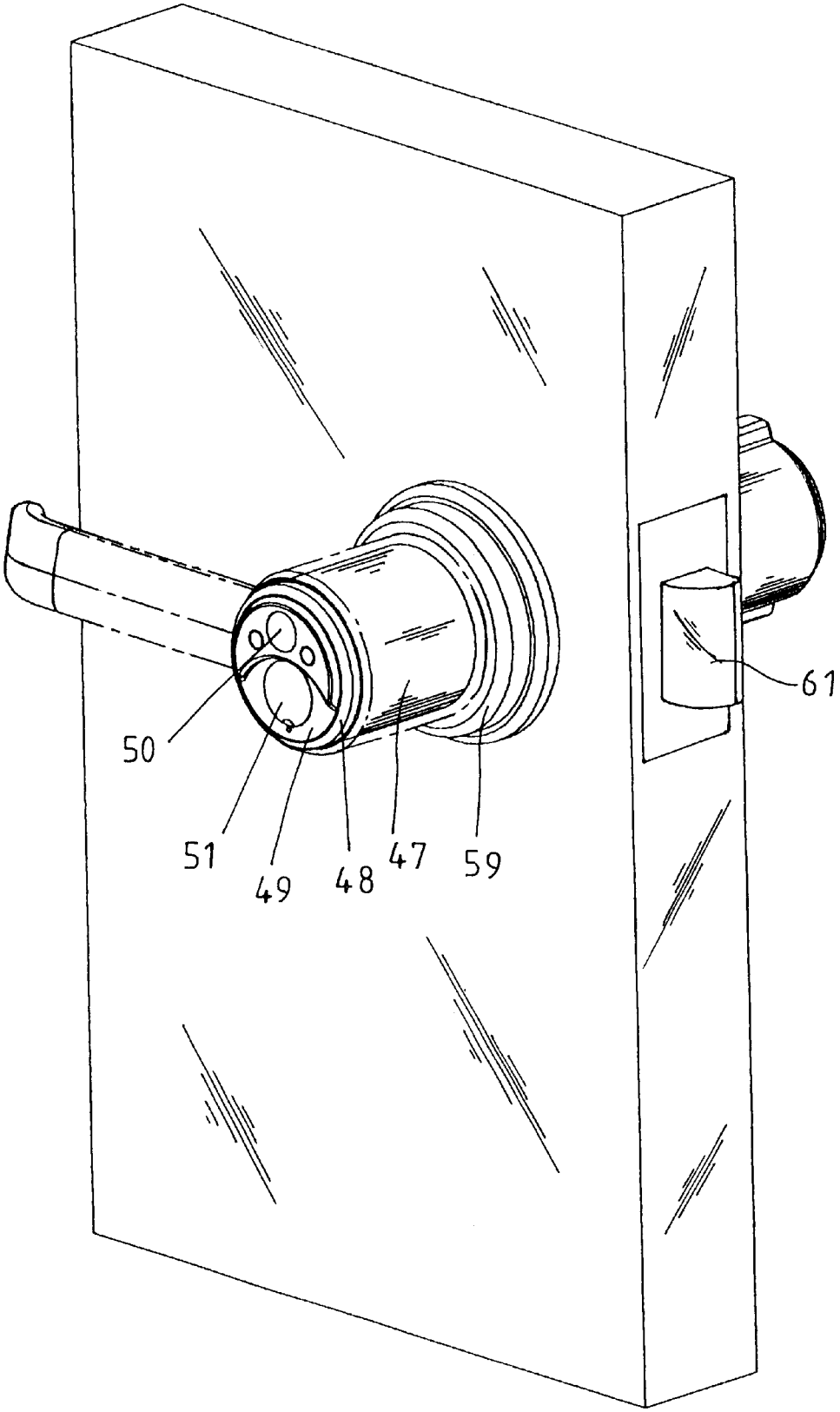
FIG. 8 shows a schematic view of the rotating mechanism of the present invention.
Figure 9:
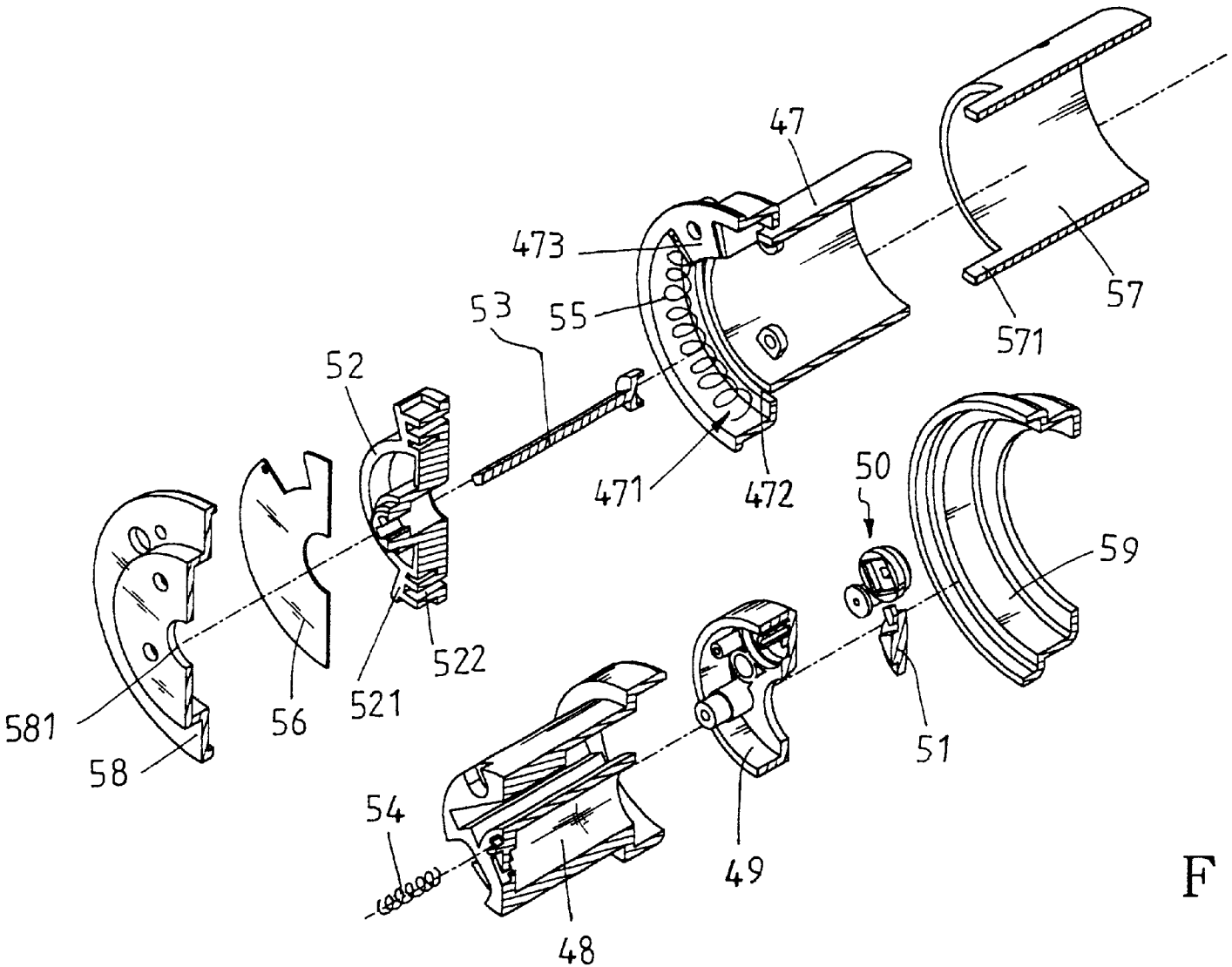
FIG. 9 shows an exploded view of the rotating mechanism of the present invention.
Figure 10:
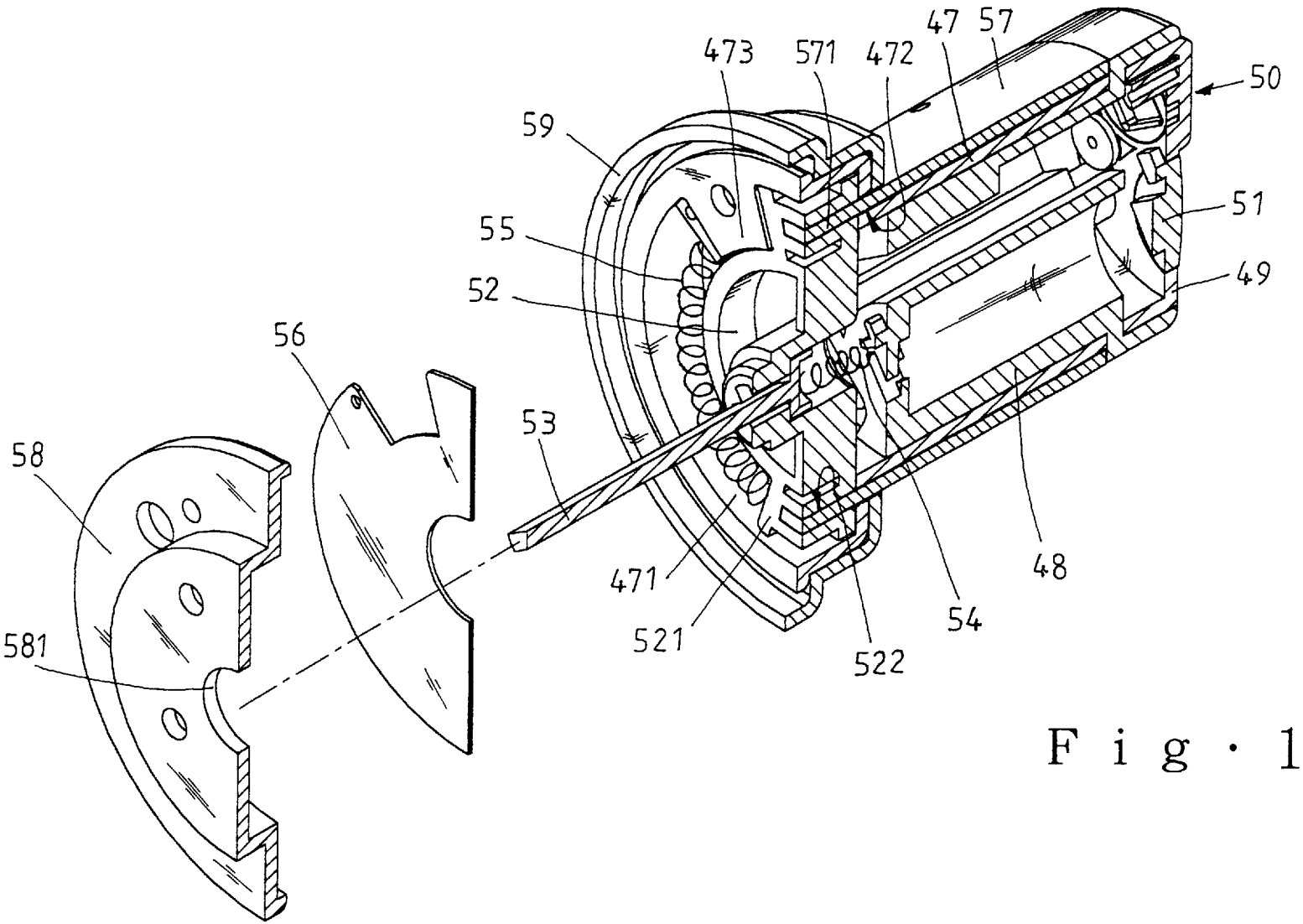
FIG. 10 shows a sectional view of the rotating mechanism of the present invention in combination

As shown in FIGS. 8–10, the control structure of the present invention cooperates with the rotating mechanism disposed in the internal side of the door. The rotating mechanism comprises the component parts, which are described hereinafter.

An outer sleeve 47 is provided at the front end with a stepped slot 471 having a plurality of slot holes 472.

A battery mount 48 is disposed in the rear end of the outer sleeve 47 and is provided in the rear end thereof with a press key seat 49 which is provided with a plurality of press buttons 50 and battery protective covers 51.

A dialing sleeve ring 52 is disposed in the stepped slot 471 of the outer sleeve 47 and is provided with a lock core 53. A spring 54 is disposed between the lock core 53 and the battery mount 48. The dialing sleeve ring 52 is further provided with a protruded portion 521 which is provided with a slot hole 522 corresponding in location to the slot hole 472 of the outer sleeve 47. A spring 55 is disposed between the protruded portion and the stop portion 473 of the the stepped slot 471 of the outer sleeve 47. The dialing sleeve ring 52 is disposed securely in the outer sleeve 47 by means of the fastening piece 56 which has a through hole. The lock core 53 is jutted out.

A rotating ring sleeve 57 is provided at the front end with an insertion portion 571 corresponding in location to the slot hole 472 of the outer sleeve 47 and is fitted over the outer sleeve 47 such that the insertion portion 571 is inserted into the slot hole 472, 522 of the outer sleeve 47 and the dialing sleeve ring 52. The door knob is fastened with the rotating sleeve ring 57 such that the door knob controls from the internal side of the door the dialing sleeve ring 52 and the lock core 53.

A bottom seat 58 is fastened with the protruded bolt 462 of the bottom seat 46 such that the bottom seat 58 is fastened with the internal side of the door, and that the bottom seat 58 is fastened with the outer sleeve 47. The bottom seat 58 is provided with a through hole 581 via which the lock core 53 is jutted out to fasten with the insertion slot 381 of the insertion seat 38.

A decorative cover 59 is joined with the outer sleeve 47.

Figure 11:
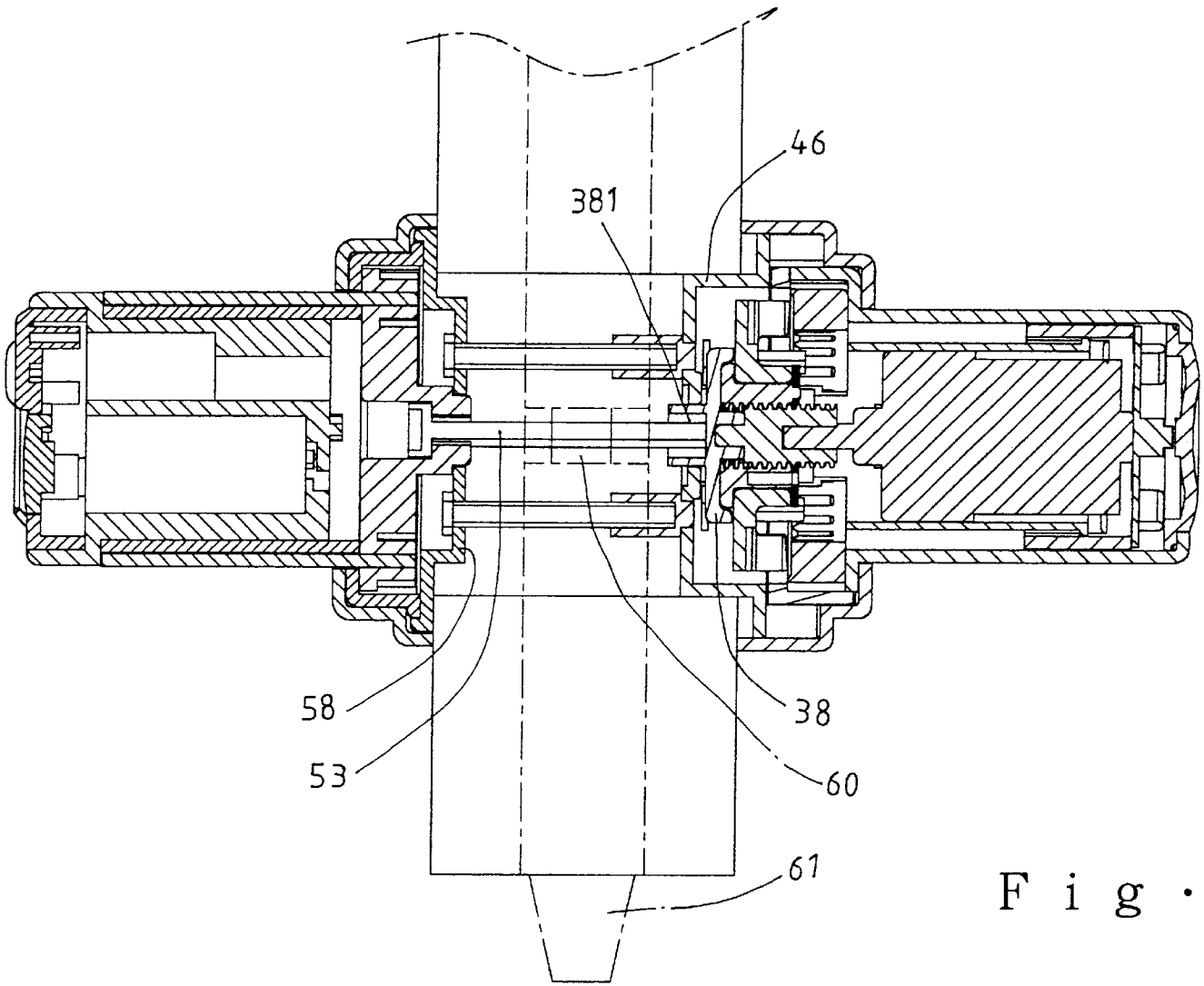
FIG. 11 shows a schematic view of the control structure and the rotating mechanism of the present invention.

As shown in FIGS. 8 and 11, the lock core 53 of the bottom seat 58 of the rotating mechanism of the internal side of the door is disposed in the retaining block 60 of the retaining mechanism such that the lock tongue 61 of the retaining mechanism is linked with the retaining block 60, and that the end of the lock core 53 is fitted into the insertion slot 381 of the insertion seat 38 of the bottom seat 46, thereby enabling the control structure to control the rotation of the lock core 53 from the external side of the door, so as to link the lock tongue 61 of the retaining mechanism.

Figure 12:
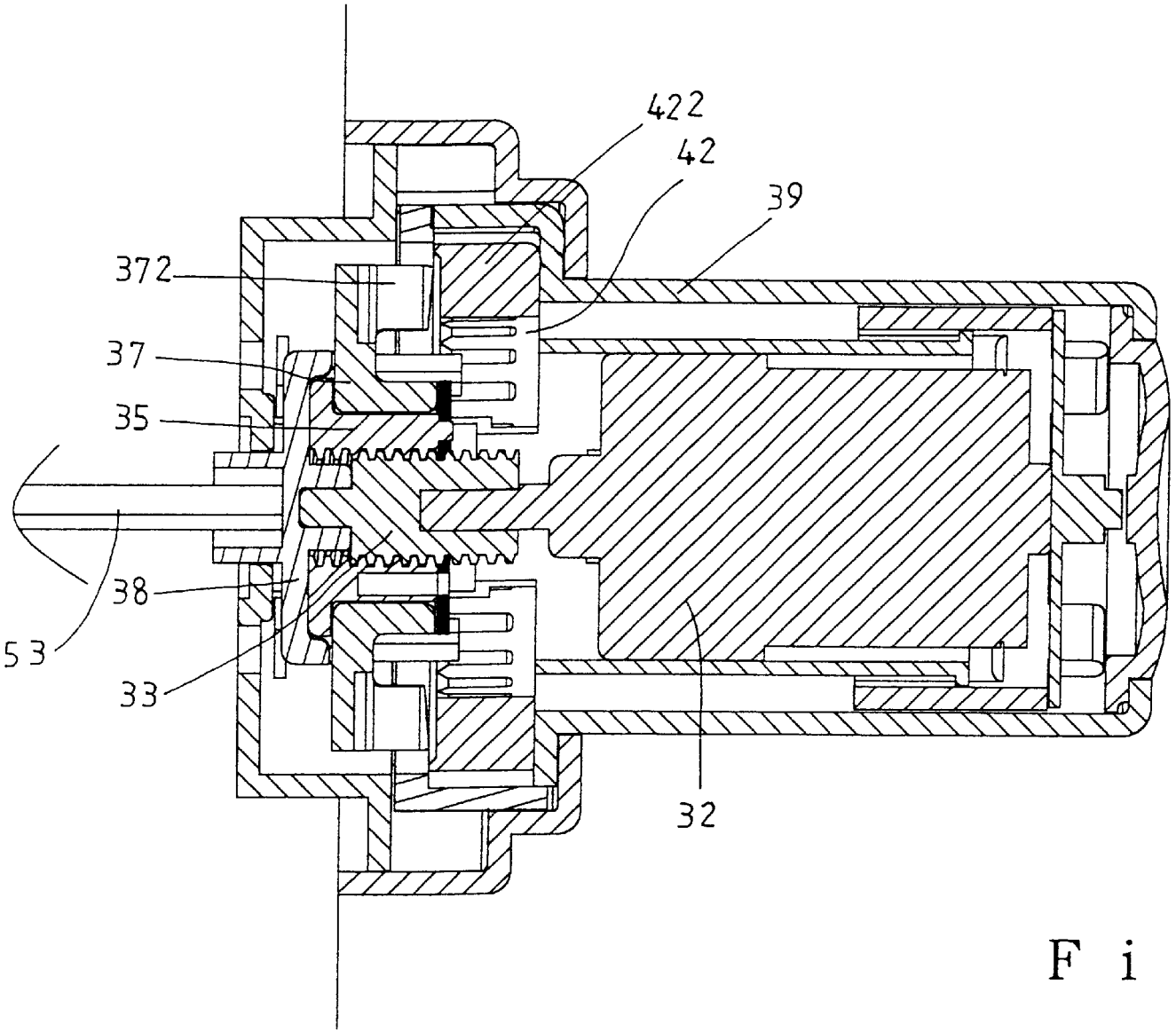
FIG. 12 shows a schematic view of the locking mechanism of the present invention.

As shown in FIG. 12, the present invention is locked by entering the encode-decode (such as the keyboard code, remote controller, sensor, etc.) so as to start the motor 32 electronically. As the motor 32 is started, the threaded sleeve 35 is driven by the threaded rod 33 of the motor 32 to displace such that the threaded sleeve 35 actuates the retaining slot 372 of the actuating ring 37 to move away from the retaining teeth 422 of the retaining ring 42 of the outer sleeve seat 39. As a result, the lock core 53 can not be turned by the outer sleeve seat 39 via the actuating ring 37 and the insertion seat 38. The electronic lock of the present invention is thus kept in the locking state even after the power interruption.

Figure 7:
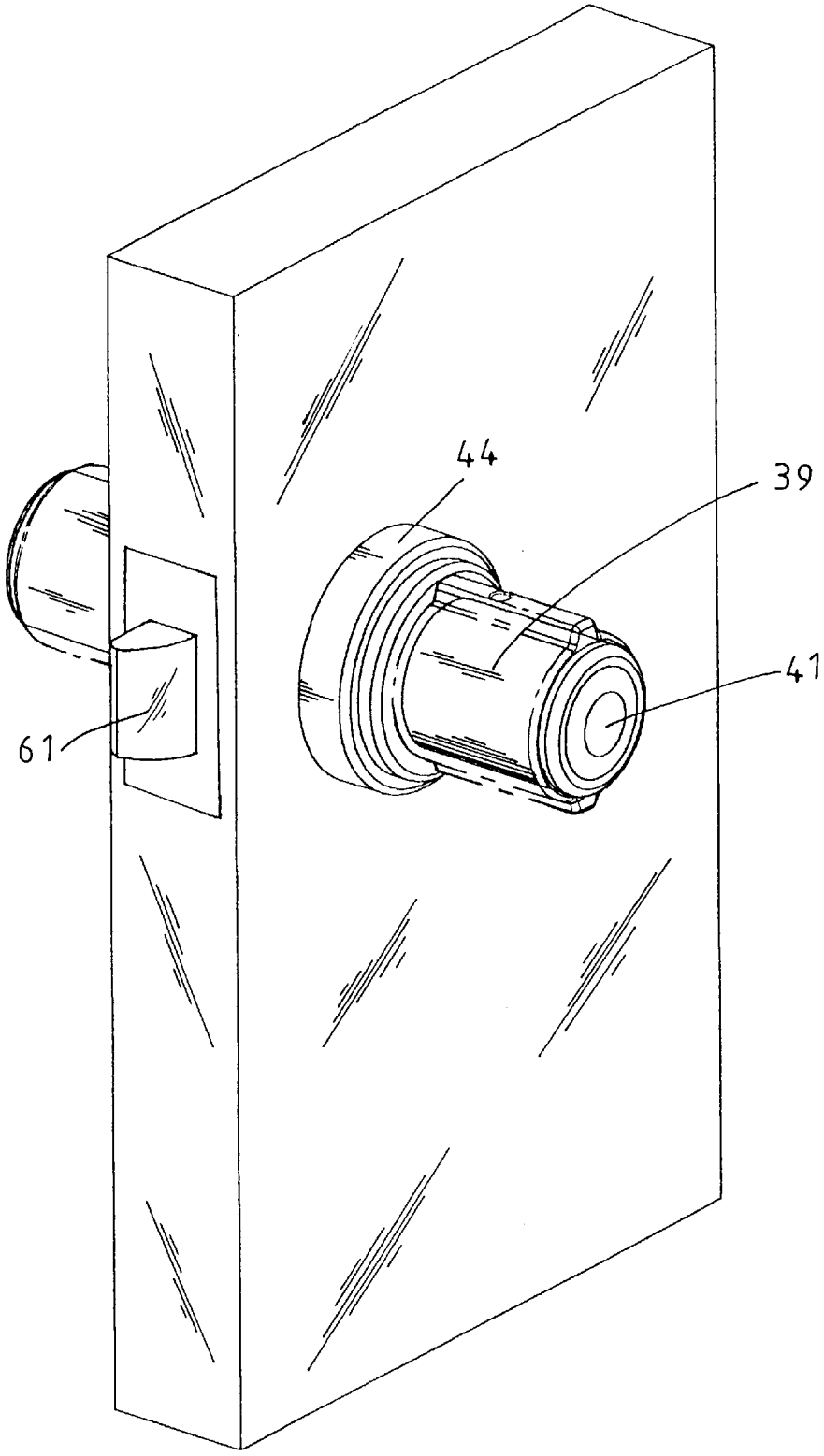
FIG. 7 shows a schematic view of the present invention that is fastened with a door.
Figure 13:
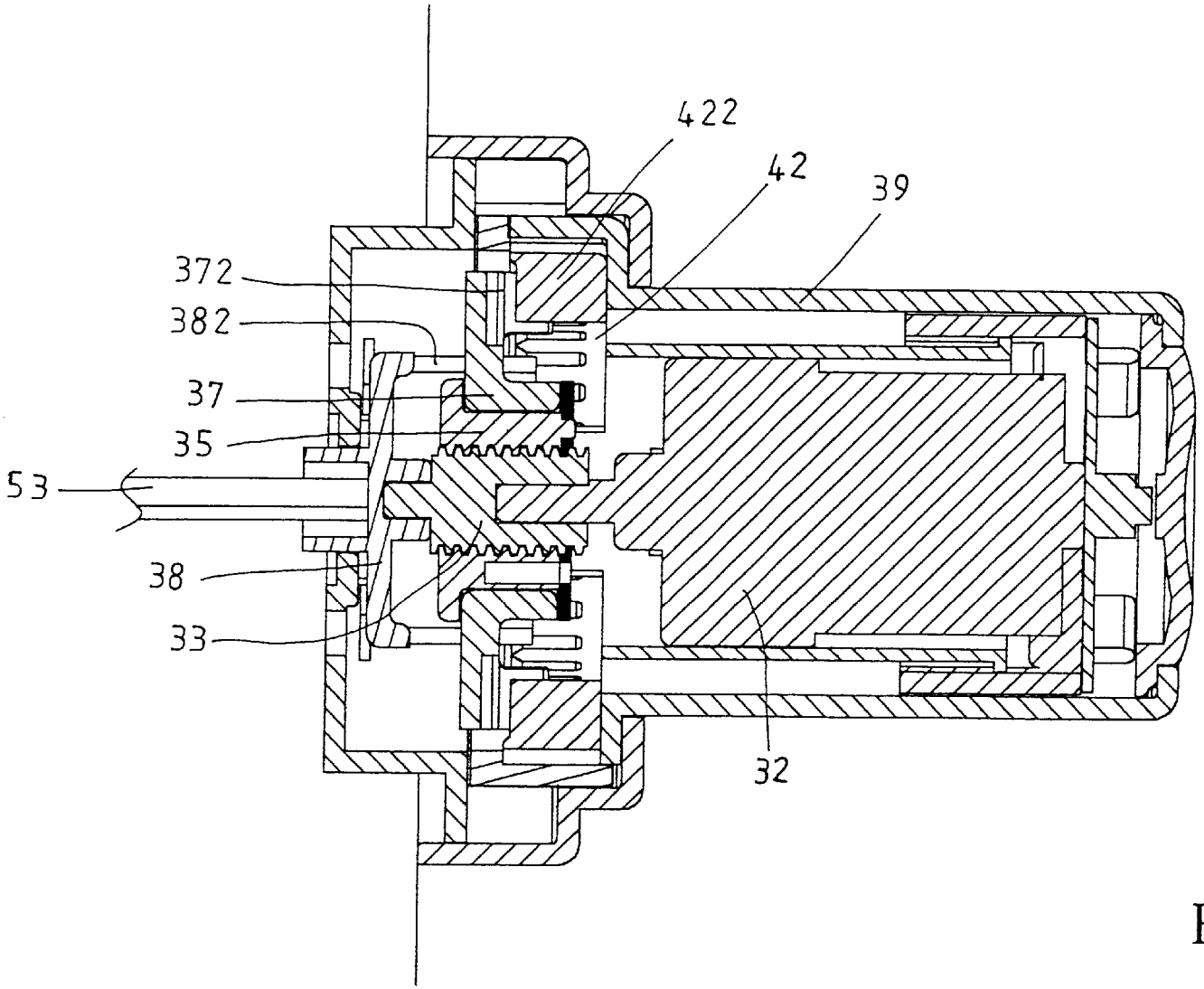
FIG. 13 shows a schematic view of the unlocking mechanism of the present invention.

As shown in FIGS. 7, 11, and 13, the electronic lock of the present invention in the locking state is unlocked by entering the encode-decode to start the motor 32. As the motor 32 is started, the threaded sleeve 35 is driven by the threaded rod 33 of the motor 32 to displace in reverse such that the threaded sleeve 35 actuates the retaining slot 372 of the actuating ring 37 to engage the retaining teeth 422 of the retaining ring 42 of the outer sleeve seat 39. As a result, the insertion slide slot 382 of the insertion seat 38 is urged by the actuating ring 37, thereby linking the insertion seat 38 so as to turn the lock core 53. The electronic lock of the present invention is thus unlocked. As the door knob of the external side of the door is turned, the lock core 53 actuates the retaining block 60 of the retaining mechanism to bring about the retraction of the lock tongue 61. The door can be thus opened.

Figure 14:
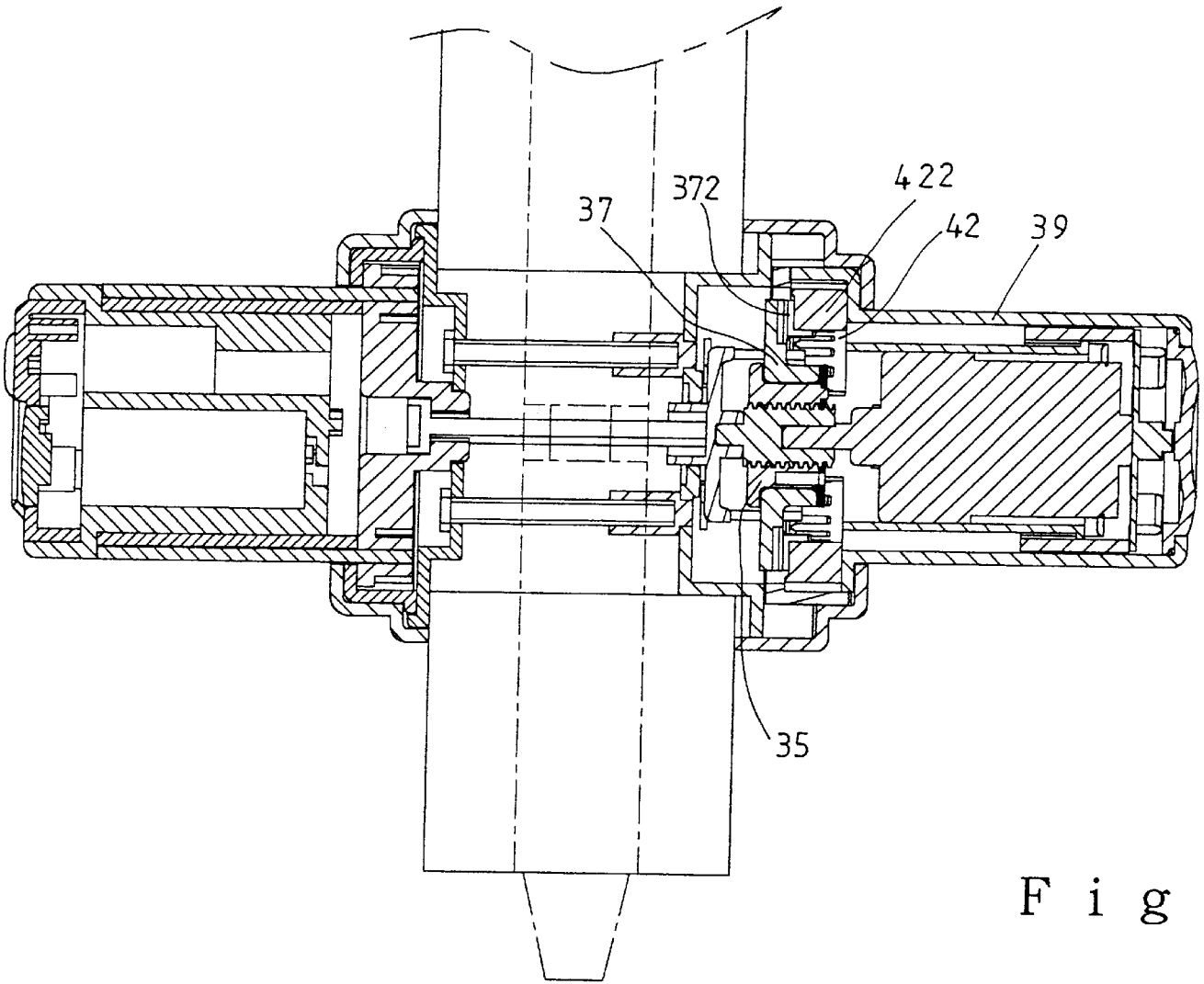
FIG. 14 shows a schematic view of the present invenion in use.

As shown in FIGS. 13 and 14, in the wake of power interruption, the threaded sleeve 35 is fixed. As a result, the retaining slot 372 of the actuating ring 37 is retained on the retaining teeth 422 of the retaining ring 42 of the outer sleeve seat 39. The electronic lock is in the unlocking state. However, the outer sleeve seat 39 is still linked with the lock core 49. The door can be opened or closed without the entry of the encode-decode, so as to facilitate the entry or the departure of people. In other words, the electronic lock of the present invention can be kept in the unlocking state for a prolonged period of time in the absence of the power supply. The electronic lock of the present invention is therefore energy efficient.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An electronic lock comprising:

An inner sleeve seat provided at a front end with a notch, in a periphery with a position confining slot, and in a rear end with a motor having a threaded rotary shaft;

a threaded sleeve provided with inner threads which are engaged with said threaded rotary shaft of said motor, said threaded sleeve further provided in a front end with a lug which is fitted into an actuating ring having an outer projection, said outer projection being provided with a retaining slot, said threaded sleeve being disposed in said inner sleeve seat such that said lug is inserted into said position confining slot, and that said outer projection of said actuating ring is jutted out of said notch of said inner sleeve seat;

an insertion seat fitted over the front end of said threaded sleeve and provided at a front end thereof with an insertion slot and an insertion slide slot for retaining said outer projection of said actuating ring;

an outer sleeve seat fitted over said inner sleeve seat and provided with retaining teeth which are engaged with said retaining slot of said actuating ring of said threaded sleeve;

a fixation sleeve ring fitted over said outer sleeve seat; and a bottom seat provided with a through hole for fastening said inner sleeve seat and said fixation sleeve ring such that said insertion slot of said insertion seat is jutted out of said through hole, and that said bottom seat is fastened with the external side of a door, and further that said bottom seat is opposite in location to a lock core of a rotating mechanism fastened with the internal side of the door, and still that said insertion slot of said insertion seat is fitted over said lock core, thereby resulting in the locking or the unlocking of a retaining mechanism of the door.

2. The electronic lock as defined in claim 1, wherein said rotary shaft of said motor is connected with a threaded rod whereby said threaded rod is engaged with said inner threads of said threaded sleeve.

3. The electronic lock as defined in claim 1, wherein said inner sleeve seat is provided in a rear end with a circuit board for regulating said motor; wherein said outer sleeve seat is provided in a rear end with a hole for disposing a protective cover.

4. The electronic lock as defined in claim 1, wherein said threaded sleeve is provided in one side with a fastening piece fastened therewith for fixing said actuating ring; wherein said inner sleeve seat and said outer sleeve seat are provided with a partition ring located therebetween.

5. The electronic lock as defined in claim 1, wherein said outer sleeve seat is provided in one side with a plurality of insertion blocks whereby said insertion blocks are inserted into insertion slots of a retaining ring, said retaining ring provided with a plurality of retaining teeth for meshing with said retaining slot of said actuating ring, said retaining ring provided with a dialing sleeve ring fitted thereover, said dialing sleeve ring provided with a plurality of indentations and dialing blocks; wherein said fixation sleeve ring is provided with a plurality of protruded blocks, said protruded blocks and said dialing blocks of said dialing sleeve ring being provided with a spring disposed therebetween.

6. The electronic lock as defined in claim 1, wherein said rotating mechanism comprises:

an outer sleeve provided in a front end with a stepped slot which is provided in a bottom thereof with a plurality of slot holes;

a battery mount disposed in a rear end of said outer sleeve and provided in a rear end thereof with a press key seat having a plurality of press buttons and battery protective covers;

a dialing sleeve ring disposed in said stepped slot of said outer sleeve and provided with a lock core, and a spring disposed between said lock core and said battery mount, said dialing sleeve ring provided in a periphery with a protruded portion which is provided with a slot hole corresponding in location to said slot hole of said outer sleeve, said dialing sleeve ring being held securely in said outer sleeve by a fastening piece such that said lock core is jutted out;

a rotating ring sleeve provided at a front end with an insertion portion corresponding in location to said slot hole of said outer sleeve, said rotating ring sleeve being fitted over said outer sleeve such that said insertion portion is inserted into said slot holes of said outer sleeve and said dialing sleeve ring for controlling from the internal side of the door said dialing sleeve ring, said lock core, and said retaining mechanism;

a bottom-seat fastened with said bottom seat of said control structure disposed in the external side of the door such that said bottom seat is fastened with said outer sleeve, said bottom seat being provided with a through hole via which said lock core is jutted out to link with said retaining mechanism such that said lock core is received at one end thereof in said insertion slot of said insertion seat; and a decorative cover covering said outer sleeve.

7. The electronic lock as defined in claim 6, wherein said stepped slot of said outer sleeve is provided with a stop portion; wherein said stop portion and said protruded portion of said dialing sleeve ring are provided with a spring disposed therebetween.

8. The electronic lock as defined in claim 1, wherein said lock core is linked with said retaining mechanism such that said lock core is put through said retaining block of said retaining mechanism, and that said lock core actuates a lock tongue to extract or retract, so as to control the opening and the closing of the door in which said retaining mechanism is disposed.

* * * * *